US006193276B1

(12) United States Patent
Sottile et al.

(10) Patent No.: US 6,193,276 B1
(45) Date of Patent: Feb. 27, 2001

(54) SKATEBOARD

(76) Inventors: Vincent N. Sottile, 668 E. Dexter St., Covina, CA (US) 91723; Vincent Sottile, 1209 N. Lyman Ave. #101, Covina, CA (US) 91724

( * ) Notice: Subject to any disclaimer, the term of this patent is extended or adjusted under 35 U.S.C. 154(b) by 0 days.

(21) Appl. No.: 09/365,044

(22) Filed: Jul. 30, 1999

(51) Int. Cl.[7] ..... A63C 11/18
(52) U.S. Cl. ..... 280/816; 280/87.042
(58) Field of Search ..... 280/809, 816, 280/87.042, 601, 607, 11.14, 609; 441/70, 74, 75

(56) References Cited

U.S. PATENT DOCUMENTS 4,159,121 * 6/1979 Spitzke ..... 280/87.04
4,411,442 * 10/1983 Rills ..... 280/221
4,592,734 * 6/1986 Metiver ..... 441/74
5,484,312 * 1/1996 Zepeda ..... 441/74
5,544,919 * 8/1996 Tinkler ..... 280/809

* cited by examiner

*Primary Examiner*—Lanna Mai

(57) ABSTRACT

A skateboard for helping hold a rider's feet on the board. The skateboard includes a board with upper and lower faces, a pair of opposite ends, and ground engaging wheels mounted to the lower face of the board. The board also has a pair of toe clips with one of the toe clips located at one end of the board and the other of the toe clips located at the other end of the board. Each toe clip has an upper portion and an arcuate lower portion. The upper portion of each toe clip is spaced above the upper face of the board. The lower portion of each toe clip connects the upper portion of the respective toe clip to the adjacent end of the board.

7 Claims, 2 Drawing Sheets

SKATEBOARD

BACKGROUND OF THE INVENTION

1. Field of the Invention

The present invention relates to skateboards and more particularly pertains to a new skateboard for helping hold a rider's feet on the board.

2. Description of the Prior Art

The use of skateboards is known in the prior art. More specifically, skateboards heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,544,919; U.S. Pat. No. 4,159,121; U.S. Pat. No. 3,535,454; U.S. Pat. No. 5,167,553; U.S. Pat. No. Des. 257,052; and U.S. Pat. No. 2,9590,118.

While these devices fulfill their respective, particular objectives and requirements, the aforementioned patents do not disclose a new skateboard. The inventive device includes a board with upper and lower faces, a pair of opposite ends, and ground engaging wheels mounted to the lower face of the board. The board also has a pair of toe clips with one of the toe clips located at one end of the board and the other of the toe clips located at the other end of the board. Each toe clip has an upper portion and an arcuate lower portion. The upper portion of each toe clip is spaced above the upper face of the board. The lower portion of each toe clip connects the upper portion of the respective toe clip to the adjacent end of the board.

In these respects, the skateboard according to the present invention substantially departs from the conventional concepts and designs of the prior art, and in so doing provides an apparatus primarily developed for the purpose of helping hold a rider's feet on the board.

SUMMARY OF THE INVENTION

In view of the foregoing disadvantages inherent in the known types of skateboards now present in the prior art, the present invention provides a new skateboard construction wherein the same can be utilized for helping hold a rider's feet on the board.

The general purpose of the present invention, which will be described subsequently in greater detail, is to provide a new skateboard apparatus and method which has many of the advantages of the skateboards mentioned heretofore and many novel features that result in a new skateboard which is not anticipated, rendered obvious, suggested, or even implied by any of the prior art skateboards, either alone or in any combination thereof.

To attain this, the present invention generally comprises a board with upper and lower faces, a pair of opposite ends, and ground engaging wheels mounted to the lower face of the board. The board also has a pair of toe clips with one of the toe clips located at one end of the board and the other of the toe clips located at the other end of the board. Each toe clip has an upper portion and an arcuate lower portion. The upper portion of each toe clip is spaced above the upper face of the board. The lower portion of each toe clip connects the upper portion of the respective toe clip to the adjacent end of the board.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new skateboard apparatus and method which has many of the advantages of the skateboards mentioned heretofore and many novel features that result in a new skateboard which is not anticipated, rendered obvious, suggested, or even implied by any of the prior art skateboards, either alone or in any combination thereof.

It is another object of the present invention to provide a new skateboard which may be easily and efficiently manufactured and marketed.

It is a further object of the present invention to provide a new skateboard which is of a durable and reliable construction.

An even further object of the present invention is to provide a new skateboard which is susceptible of a low cost of manufacture with regard to both materials and labor, and which accordingly is then susceptible of low prices of sale to the consuming public, thereby making such skateboard economically available to the buying public.

Still yet another object of the present invention is to provide a new skateboard which provides in the apparatuses and methods of the prior art some of the advantages thereof, while simultaneously overcoming some of the disadvantages normally associated therewith.

Still another object of the present invention is to provide a new skateboard for helping hold a rider's feet on the board.

Yet another object of the present invention is to provide a new skateboard which includes a board with upper and lower faces, a pair of opposite ends, and ground engaging wheels mounted to the lower face of the board. The board also has a pair of toe clips with one of the toe clips located at one end of the board and the other of the toe clips located at the other end of the board. Each toe clip has an upper portion and an arcuate lower portion. The upper portion of each toe clip is spaced above the upper face of the board. The lower portion of each toe clip connects the upper portion of the respective toe clip to the adjacent end of the board.

Still yet another object of the present invention is to provide a new skateboard that helps enhance a rider's control when steering the skateboard.

Even still another object of the present invention is to provide a new skateboard that holds the rider's feet to the board so that the rider may perform various skateboard stunts and tricks without loosing their footing on the board.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
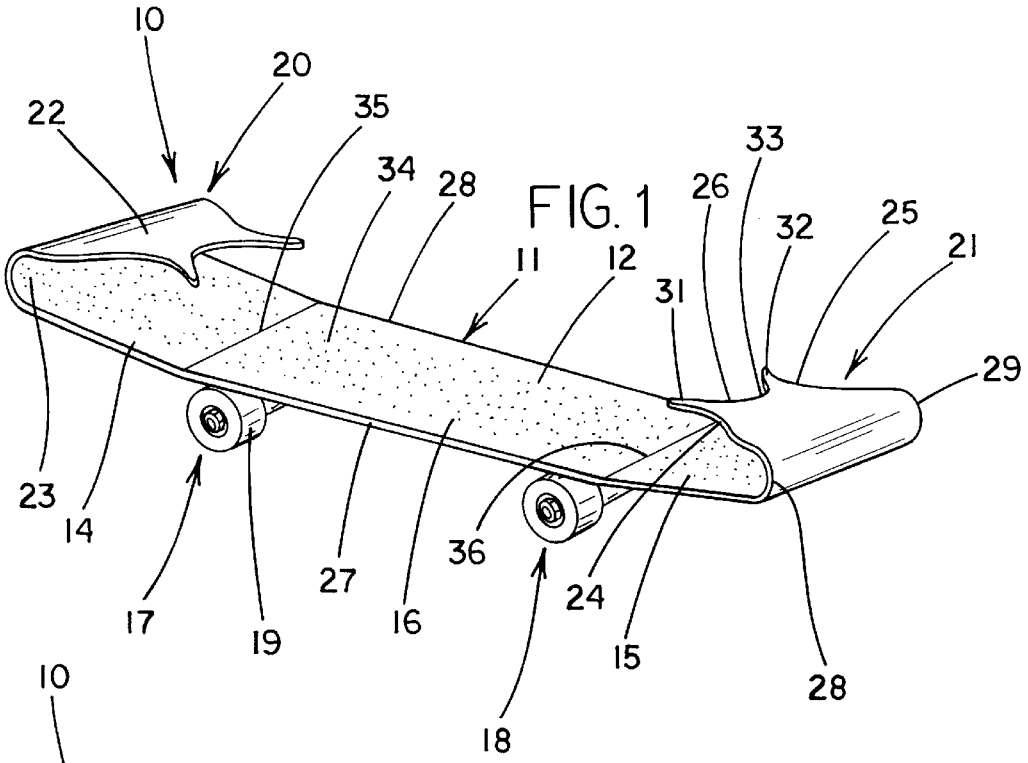
FIG. 1 is a schematic perspective view of a new skateboard according to the present invention.
Figure 2:
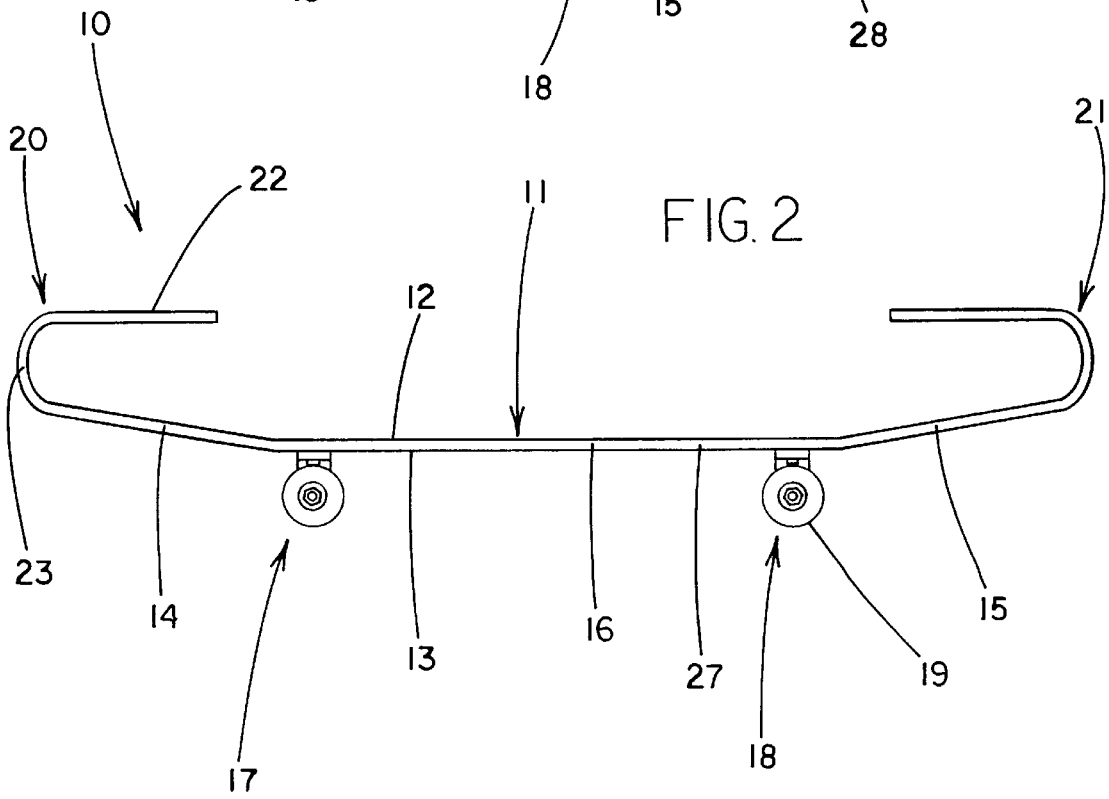
FIG. 2 is a schematic side view of the present invention.

With reference now to the drawings, and in particular to FIGS. 1 through 4 thereof, a new skateboard embodying the principles and concepts of the present invention and generally designated by the reference numeral 10 will be described.

As best illustrated in FIGS. 1 through 4, the skateboard 10 generally comprises a board with upper and lower faces, a pair of opposite ends, and ground engaging wheels mounted to the lower face of the board. The board also has a pair of toe clips with one of the toe clips located at one end of the board and the other of the toe clips located at the other end of the board. Each toe clip has an upper portion and an arcuate lower portion. The upper portion of each toe clip is spaced above the upper face of the board. The lower portion of each toe clip connects the upper portion of the respective toe clip to the adjacent end of the board.

In closer detail, the skateboard 10 comprises a board 11 having upper and lower faces 12,13, and a pair of opposite ends. In one embodiment, the board has a spaced apart pair of end regions 14,15 and a middle region 16 interposed between the end regions of the board, the end regions of the board lying in planes extending at an obtuse angle to a plane in which the middle region of the board lies.

The board also has a spaced apart pair of wheel assemblies 17,18 coupled to the lower face of the board. Each of the wheel assemblies is positioned below the middle region of the board with one of the wheel assemblies positioned towards one of the end regions of the board and the other of the wheel assemblies positioned towards the other of the end regions of the board. Each wheel assembly has a pair of ground engaging rotatable wheels 19 designed for skateboarding.

The board has a pair of toe clips 20,21. One of the toe clips is located at one end of the board and the other of the toe clips is located at the other end of the board. Each toe clip has an upper portion 22 and an arcuate lower portion 23. The upper portion of each toe clip is spaced above the upper face of the board over the adjacent end region of the board. The lower portion of each toe clip connects the upper portion of the respective toe clip to the adjacent end region at the adjacent end of the board.

Figure 3:
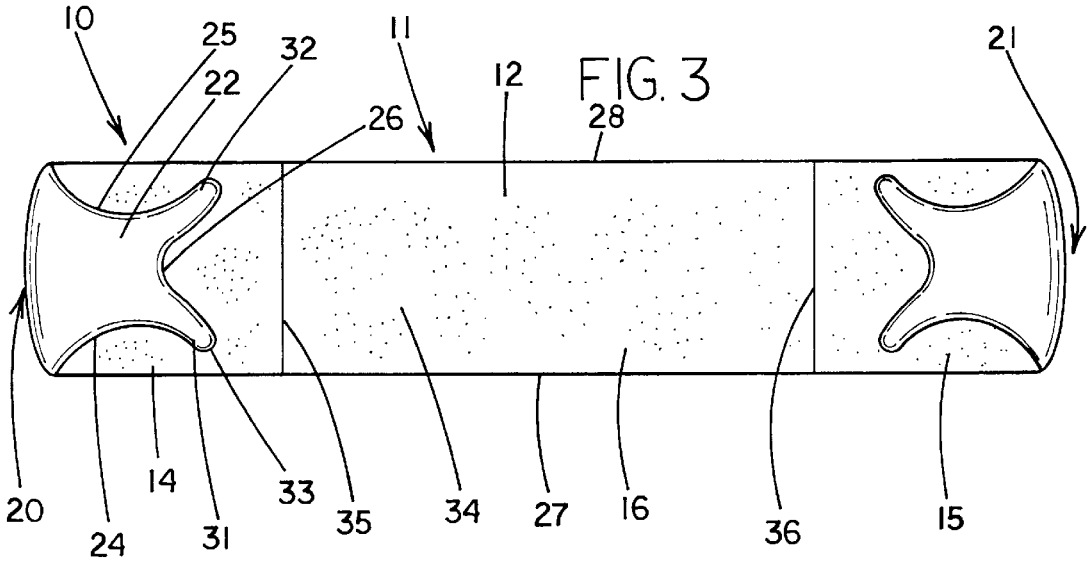
FIG. 3 is a schematic top view of the present invention.
Figure 4:
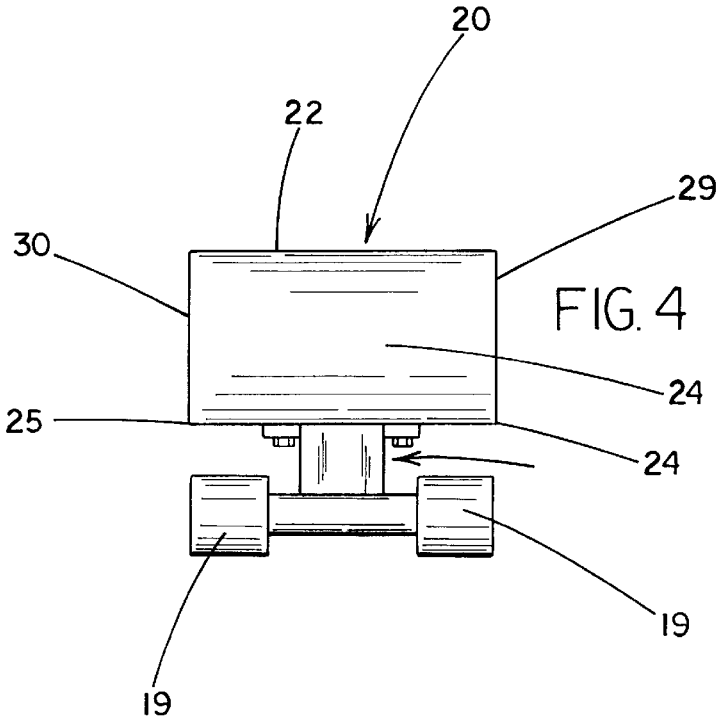
FIG. 4 is a schematic end view of the present invention.

The upper portion of each toe clip may has a spaced apart pair of arcuate side edges 24,25 and an arcuate terminal edge 26 connecting the side edges of the respective upper portion together. As best illustrated in FIG. 3, the terminal edges of the upper portions of the toe clip have concavities facing one another. The side edges of each upper portion has outwardly facing concavities.

The board has a pair of side edges 27,28. The lower portions of the toe clips each have a pair of generally C-shaped side edges 29,30. In one embodiment, the side edges 27,28 of the board may be extended substantially parallel to each other. In such an embodiment, each side edge 29,30 of the lower portions of the toe clips lie in a common plane with the adjacent side edge 27,28 of the board.

The terminal and side edges of each upper portion form a pair of arms 31,32 outwardly extending away from each other. The arms of the upper portions of the toe clips each have a rounded terminal end 33. The rounded terminal ends of the arms of each upper portion are positioned between the common planes of the side edges of the board and lower portions of the toe clips.

In use, the upper face of the board is designed for resting the feet of a rider thereon. In one embodiment, the upper face of the board may have a substantially coextensive roughened surface 34 such as a sand paper type material for frictionally enhancing contact between the upper face of the board and the feet of the rider to help prevent the feet of the rider from coming off of the upper face of the board.

The toe clips each define a toe space above the adjacent end region of the board. In use, the toe spaces each are designed for receiving therein the toe end of the rider's foot on the upper face of the board such that each foot is held to the upper surface of the board with the toe clips. The arcuate terminal edges of the upper portions of the toe clips define ankle spaces which are designed for receiving a front of a rider's ankle therein so that the front of the rider's ankle may abut the terminal edge and so that the arms of the respective upper portion help to hold the foot and leg of the rider in place on the upper face of the board.

In one embodiment, the terminal ends of the arms of each upper portion may lie along a line extending parallel to a boundary line 35,36 extending between the adjacent end region of the board and the middle region of the board. The boundary lines of the board are positioned between the lines in which the terminal ends of the arms lie. The respective vertical plane in which each boundary line lies is spaced apart from the vertical plane in which the adjacent line of the terminal ends of the arms of the adjacent upper portion lie so that heel regions of the rider's feet may be positioned over the boundary lines without the terminal edges of the upper portions of the toe clips interfering with such a positioning of the rider's feet.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A skateboard, comprising:

a board having upper and lower faces, a pair of opposite ends, and ground engaging wheels mounted to said lower face of said board;

said board having a pair of toe clips, one of said toe clips being located at one end of said board and the other of said toe clips being located at the other end of said board;

each toe clip having an upper portion and an arcuate lower portion;

said upper portion of each toe clip being spaced above said upper face of said board;

said lower portion of each toe clip connecting the upper portion of the respective toe clip to the adjacent end of said board; and wherein said upper portion of each toe clip has a spaced apart pair of arcuate side edges and an arcuate terminal edge connecting said side edges of the respective upper portion together, said terminal edges of said upper portions of said toe clip having concavities facing one another, said side edges of each upper portion having outwardly facing concavities.

2. The skateboard of claim 1, wherein said board has a spaced apart pair of end regions and a middle region interposed between said end regions of said board, said end regions of said board lying in planes extending at an obtuse angle to a plane in which said middle region of said board lies.

3. The skateboard of claim 1, wherein said board has a pair of side edges, said side edges of said board being extended substantially parallel to each other, and wherein said lower portions of said toe clips each having a pair of side edges, each side edge of said lower portions of said toe clips lying in a common plane with the adjacent side edge of said board.

4. A skateboard, comprising:

a board having upper and lower faces, and a pair of opposite ends;

said board having a spaced apart pair of end regions and a middle region interposed between said end regions of said board, said end regions of said board lying in planes extending at an obtuse angle to a plane in which said middle region of said board lies;

said board having a spaced apart pair of wheel assemblies coupled to said lower face of said board;

each of said wheel assemblies being positioned below said middle region of said board, one of said wheel assemblies being positioned towards one of said end regions of said board and the other of said wheel assemblies being positioned towards the other of said end regions of said board;

each wheel assembly having a pair of ground engaging rotatable wheels;

said board having a pair of toe clips, one of said toe clips being located at one end of said board and the other of said toe clips being located at the other end of said board;

each toe clip having an upper portion and an arcuate lower portion;

said upper portion of each toe clip being spaced above said upper face of said board over the adjacent end region of said board;

said lower portion of each toe clip connecting the upper portion of the respective toe clip to the adjacent end region at the adjacent end of said board;

said upper portion of each toe clip having a spaced apart pair of arcuate side edges and an arcuate terminal edge connecting said side edges of the respective upper portion together;

said terminal edges of said upper portions of said toe clip having concavities facing one another;

said side edges of each upper portion having outwardly facing concavities;

said board having a pair of side edges, said side edges of said board being extended substantially parallel to each other;

said lower portions of said toe clips each having a pair of generally C-shaped side edges;

each side edge of said lower portions of said toe clips lying in a common plane with the adjacent side edge of said board; and said terminal and side edges of each upper portion forming a pair of arms outwardly extending away from each other.

5. A skateboard, comprising:

a board having upper and lower faces, a pair of opposite ends, and ground engaging wheels mounted to said lower face of said board;

said board having a pair of toe clips, one of said toe clips being located at one end of said board and the other of said toe clips being located at the other end of said board;

each toe clip having an upper portion and an arcuate lower portion;

said upper portion of each toe clip being spaced above said upper face of said board;

said lower portion of each toe clip connecting the upper portion of the respective toe clip to the adjacent end of said board; and wherein said upper portion of each toe clip has a pair of side edges and an arcuate terminal edge connecting said side edges of the respective upper portion together, said terminal edges of said upper portions of said toe clip having concavities facing one another.

6. The skateboard of claim 5, wherein said board has a spaced apart pair of end regions and a middle region interposed between said end regions of said board, said end regions of said board lying in planes extending at an obtuse angle to a plane in which said middle region of said board lies.

7. The skateboard of claim 5, wherein said board has a pair of side edges, said side edges of said board being extended substantially parallel to each other, and wherein said lower portions of said toe clips each having a pair of side edges, each side edge of said lower portions of said toe clips lying in a common plane with the adjacent side edge of said board.

* * * * *